US008822869B2

(12) United States Patent
Yeon

(10) Patent No.: US 8,822,869 B2
(45) Date of Patent: Sep. 2, 2014

(54) SWITCHING MECHANISM FOR GAS INSULATED SWITCHGEAR

(75) Inventor: Man Seung Yeon, Yangju-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 183 days.

(21) Appl. No.: 13/446,221

(22) Filed: Apr. 13, 2012

(65) Prior Publication Data

US 2012/0273464 A1 Nov. 1, 2012

(30) Foreign Application Priority Data

Apr. 27, 2011 (KR) ..... 10-2011-0039744

(51) Int. Cl.
*H01H 33/42* (2006.01)

(52) U.S. Cl.
USPC ..... 218/118; 361/135

(58) Field of Classification Search
CPC ..... H01H 1/221; H01H 1/502; H01H 3/3026; H01H 13/28; H01H 13/30; H01H 21/42
USPC ..... 218/116–118; 361/135
See application file for complete search history.

(56) References Cited

U.S. PATENT DOCUMENTS

| | | | | |
|---|---|---|---|---|
| 3,531,609 | A * | 9/1970 | Gratzmuller | 218/116 |
| 4,030,055 | A * | 6/1977 | Kotos | 335/195 |
| 6,373,675 | B1 * | 4/2002 | Yamazaki et al. | 361/135 |
| 6,506,990 | B2 * | 1/2003 | Marin-Pache et al. | 200/400 |
| 8,309,872 | B2 * | 11/2012 | Peter et al. | 218/118 |
| 2003/0034331 | A1 | 2/2003 | Kowalyshen et al. | |

FOREIGN PATENT DOCUMENTS

| | | |
|---|---|---|
| CN | 1056766 | 12/1991 |
| JP | 1-183025 | 7/1989 |
| JP | 7-6668 | 1/1995 |
| JP | 2003-257292 | 9/2003 |
| JP | 2004-079249 | 3/2004 |
| KR | 2003-0075832 | 9/2003 |
| KR | 2003-0075833 | 9/2003 |
| KR | 2007-0008041 | 1/2007 |
| KR | 10-0770330 | 10/2007 |

(Continued)

OTHER PUBLICATIONS

Russian Federation Federal Service for Intellectual Property, Patents and Trademarks Application Serial No. 2012117115/07, Notice of Allowance dated Dec. 12, 2013, 7 pages.

(Continued)

*Primary Examiner* — Truc Nguyen
(74) *Attorney, Agent, or Firm* — Lee, Hong, Degerman, Kang & Waimey

(57) ABSTRACT

A switching mechanism for a gas insulated switchgear includes: a stationary contactor having a stationary arc contactor portion and a stationary main contactor portion; a movable arc contactor which is linearly movable; a movable main contactor which is linearly movable; a cylinder rod which provides driving power for linear motion to the movable main contactor and the movable arc contactor; a connecting rod which is connected to the cylinder rod; a stationary cylinder having a hollow guide tube portion for guiding the linear motion of the cylinder rod and the connecting rod; and a spring which charges elastic energy when the movable main contactor and the movable arc contactor move to the contacting position and discharge the elastic energy when the movable main contactor and the movable arc contactor move to the separating position.

4 Claims, 4 Drawing Sheets

(56) References Cited

FOREIGN PATENT DOCUMENTS

| | | |
|---|---|---|
| RU | 2178927 | 1/2002 |
| SU | 1345271 | 10/1987 |
| SU | 1700628 | 12/1991 |

OTHER PUBLICATIONS

The State Intellectual Property Office of the People's Republic of China Application Serial No. 201210129865.9, Office Action dated Apr. 2, 2014, 6 pages.

* cited by examiner

SWITCHING MECHANISM FOR GAS INSULATED SWITCHGEAR

CROSS-REFERENCE TO RELATED APPLICATION

Pursuant to 35 U.S.C. §119(a), this application claims the benefit of earlier filing date and right of priority to Korean Application No. 10-2011-0039744, filed on Apr. 27, 2011, the contents of which is incorporated by reference herein in its entirety.

BACKGROUND OF THE INVENTION

1. Field of the Invention

The present disclosure relates to a switching mechanism for a gas insulated switchgear, and particularly, to a switching mechanism for a gas insulated switchgear, which can reduce the size of an actuator as a driving energy source and reduce the overall size of the gas insulated switchgear by including a spring for charging elastic energy when it moves to a contacting position and discharging elastic energy when it moves to a separating position.

2. Background of the Invention

In general, a gas insulated switchgear is electric power equipment which is installed on an electric power transmission line or an electric power distribution line of ultra-high voltage electric power greater than several tens of kilovolts, for example, at a power plant or substation.

The gas insulated switchgear may internally include a switching mechanism having a breaking position (that is the separating position) for breaking a circuit in the event of a fault current such as a ground fault or electric shortage and a closing position (also referred to as the contacting position) for applying electric current to the circuit at normal times.

The gas insulated switchgear of this type is also referred to as a gas insulated breaker. The switching mechanism is also referred to as an arc extinguishing mechanism because it extinguishes arc by blowing an insulating gas to a contact when the circuit is broken.

The present invention relates to such a switching mechanism for a gas insulated switchgear.

The configuration and operation of the switching mechanism for the gas insulated switchgear according to the related art will be described with reference to FIGS. 1 and 2.

The switching mechanism for the gas insulated switchgear according to the related art can be generally divided into a stationary contactor 1 and 1*a* and a movable contact section 30, 10, and 40.

The stationary contactor 1 and 1*a* includes a stationary arc contactor portion 1*a* at the center and a stationary main contactor portion 1 provided to surround the stationary arc contactor portion 1*a*.

The movable contact section 30, 10, and 40 includes a stationary cylinder 10 which is hollow inside and opened at both longitudinal ends and a movable contactor portion 30 which penetrates the stationary cylinder 10 and is linearly movable.

Further, the movable contactor portion 30 includes a movable main contactor 20, a cylinder rod 31, a movable arc contactor 32, an auxiliary nozzle 33, and a main nozzle 34.

The movable contact section 30, 10, and 40 may further include a connecting rod 40 having one end to be connected to the cylinder rod 31 and the other end to be connected to a driving source (not shown) such as a spring actuator.

The movable main contactor 20 is a contactor which is linearly movable to a contacting position for contacting the stationary main contactor portion 1 or a separating position for separating from the stationary main contactor portion 1.

The movable main contactor 20 is formed further behind the movable arc contactor 32. Hence, when moving to the contacting position, the movable main contactor 20 comes in contact with the stationary contactor 1 and 1*a* later than the movable arc contactor 32 does, and when moving to the separating position, the movable main contactor 20 is separated from the stationary contactor 1 and 1*a* earlier than the movable arc contactor 32 is.

The movable main contactor 20 is connected to the movable arc contactor 32 via a piston (given no reference numeral) and linearly moves in the same direction as the linear motion of the movable arc contactor 32.

The movable arc contactor 32 is connected to the front end of the cylinder rod 31, and linearly moves to the contacting position or the separating position according to the linear motion of the cylinder rod 31.

An insulating gas compression chamber is formed by the inside of the stationary cylinder 10 and the piston, and the compression chamber communicates with internal spaces of the movable arc contactor 32, main nozzle 34, and auxiliary nozzle 33 through the cylinder rod 31.

The cylinder rod 31 is a rod which is driven and connected to the movable main contactor 20 and the movable arc contactor 32 to provide a driving power for linear motion to the movable main contactor 20 and the movable arc contactor 32.

The cylinder rod 31 is formed like an elongate cylinder being hollow inside and has a gas communication opening (not shown) which communicates with the compression chamber.

The driving power of the cylinder rod 31 is obtained from the connecting rod 40 which is connected to a driving source such as a spring actuator.

The movable arc contactor 32 is a contactor which is linearly movable to the contacting position for contacting the stationary arc contactor portion 1*a* or the separating position for separating from the stationary arc contactor portion 1*a*.

The movable arc contactor 32 protrudes further forward than the movable main contactor 20. Hence, when moving to the contacting position, the movable arc contactor 32 comes in contact with the stationary contactor 1 and 1*a* earlier than the movable main contactor 20 does, and when moving to the separating position, the movable arc contactor 32 is separated from the stationary contactor 1 and 1*a* later than the movable main contactor 20.

The main nozzle 34 is attached to a front end portion of the movable main contactor 20 by an attachment method, e.g., welding, and ejects compressed arc extinguishing gas toward the stationary arc contactor portion 1*a* so as to extinguish the arc produced when the movable arc contactor 32 is separated from the stationary arc contactor portion 1*a*.

The auxiliary nozzle 33 is attached to the movable arc contactor 32 by an attachment method, e.g., welding, so as to protrude further forward than the movable arc contactor 32, and ejects the compressed arc extinguishing gas in the compression chamber toward the main nozzle 34 so as to extinguish the arc produced when the movable arc contactor 32 is separated from the stationary arc contactor portion 1*a*.

The operation of the switching mechanism for the gas insulated switch according to the related art will be described with reference to FIGS. 1 and 2.

First of all, the movement of the switching mechanism from the separating position shown in FIG. 2 to the contacting position shown in FIG. 1 will be described.

The connecting rod 40 connected to a driving energy source (not shown) such as a spring actuator linearly moves from the separating position shown in FIG. 2 in the direction of arrow a of FIG. 1 by driving power from the driving energy source.

Then, the cylinder rod 31 connected to one end of the connecting rod 40 linearly moves in the direction of arrow a, and the movable arc contactor 32 connected to the front end of the cylinder rod 31 also linearly moves in the direction of arrow a.

Therefore, the movable main contactor 20 connected to the movable arc contactor 32 via the piston also linearly moves in the direction of arrow a.

Hereupon, the movable arc contactor 32 comes in contact with the corresponding stationary arc contactor portion 1*a*, and the movable main contactor 20 comes in contact with the corresponding stationary main contactor portion 1, thereby completing the movement to the contacting position as shown in FIG. 1.

The movement of the switching mechanism from the contacting position shown in FIG. 1 to the separating position shown in FIG. 2 is performed in a direction opposite to that of the above-described movement.

That is, the connecting rod 40 connected to the driving energy source (not shown) such as the spring actuator, linearly moves from the contacting position shown in FIG. 1 in the direction of arrow b of FIG. 2 by the driving power from the driving energy source.

Then, the cylinder rod 31 connected to one end of the connecting rod 40 linearly moves in the direction of arrow b, and the movable arc contactor 32 connected to the front end of the cylinder rod 31 also linearly moves in the direction of arrow b.

Therefore, the movable main contactor 20 connected to the movable arc contactor 32 via the piston also linearly moves in the direction of arrow b.

Hereupon, the movable arc contactor 32 is separated first from the corresponding stationary arc contactor portion 1*a*. At this time, no arc is generated because the movable arc contactor 32 is still in contact with the corresponding stationary arc contactor portion 1*a*. Subsequently, the movable arc contactor 32 is separated from the corresponding stationary arc contactor portion 1*a*. At this time, the arc extinguishing gas compressed in the compression chamber is ejected toward the stationary arc contactor portion 1*a* via the auxiliary nozzle 33 and the main nozzle 34, thereby rapidly extinguishing the arc. As such, the movement to the separating position as shown in FIG. 2 is completed.

The above-described switching mechanism for the gas insulated switchgear according to the related art receives driving energy from the spring actuator as the driving energy source in order to move to the contacting position or the separating position.

The spring actuator may be a closing spring for providing the driving energy to the contacting position and a trip spring (also referred to as an opening spring) for providing the driving energy to the separating position.

As used herein, the closing spring provides not only energy for driving the above-described switching mechanism to the contacting position, but also energy for compressing the trip spring so as to charge elastic energy for driving the switching mechanism to the separating position.

Accordingly, the elastic energy provided by the closing spring is required to be 1.5 to 2 times larger than the elastic energy provided by the trip spring.

Generally, a gas insulated switchgear can be used for longer than 20 years, during which the switching mechanism performs a lot of opening and closing operations. Thus, the switching mechanism for the gas insulated switchgear according to the related art requires high elastic energy provided by the closing spring, and therefore suffers mechanical damage and durability decrease, resulting in a decrease in the operational reliability of the switching mechanism.

SUMMARY OF THE INVENTION

Therefore, an object of the present disclosure is to provide a switching mechanism for a gas insulated switchgear which requires less elastic energy from a closing spring and a trip spring that function as a switching driving source, and therefore minimizes damage to the switching mechanism even when used for a long period of time and ensures the reliability of opening and closing operations for a long time.

The said object of the present disclosure can be achieved by providing a switching mechanism for a gas insulated switchgear according to the present disclosure, the switching mechanism comprising:

a stationary contactor having a stationary arc contactor portion at a center and a stationary main contactor portion fixedly installed at a radially outward position from the stationary arc contactor portion;

a movable arc contactor which is linearly movable to a contacting position for contacting the stationary arc contactor portion or a separating position for separating from the stationary arc contactor portion;

a movable main contactor which is provided to be connected to the movable arc contactor at a radially outward position relative to the movable arc contactor, and is linearly movable to a contacting position for contacting the stationary main contactor portion and a separating position for separating from the stationary main contactor portion;

a cylinder rod which is connected to the movable main contactor and the movable arc contactor to provide driving power for linear motion to the movable main contactor and the movable arc contactor;

a connecting rod which is connected to the cylinder rod so as to transmit a driving power from a power source;

a stationary cylinder which receives the movable arc contactor, the movable main contactor, and the cylinder rod so as to be linearly movable therein, and has a hollow guide tube portion for guiding the linear motion of the cylinder rod and the connecting rod; and a spring, one end of which is supported by a stationary spring supporting seat portion and the other end of which is supported by a movable spring supporting seat portion that is connected to the cylinder rod or the connecting rod and linearly movable, and which charges elastic energy when the movable main contactor and the movable arc contactor move to the contacting position and discharges the elastic energy when the movable main contactor and the movable arc contactor move to the separating position.

According to a preferred aspect of the present invention, the stationary spring supporting seat portion forms a through hole by radially extending from one end of the guide tube portion to the center of the guide tube portion, and permits passing through of the cylinder rod because the bore of the through hole is greater than the diameter of the cylinder rod and does not permit passing through of the spring because the bore of the through hole is less than the diameter of the spring.

According to a preferred aspect of the present invention, the movable spring supporting seat portion is configured by a flange portion of a bushing for connecting the cylinder rod and the connecting rod.

According to a preferred aspect of the present invention, the spring is configured by a coil spring which is installed to surround an outer circumferential surface of the cylinder rod between the stationary spring supporting seat portion and the movable spring supporting seat portion.

Further scope of applicability of the present application will become more apparent from the detailed description given hereinafter. However, it should be understood that the present disclosure and specific examples, while indicating preferred embodiments of the invention, are given by way of illustration only, since various changes and modifications within the spirit and scope of the invention will become apparent to those skilled in the art from the present disclosure.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Figure 1:
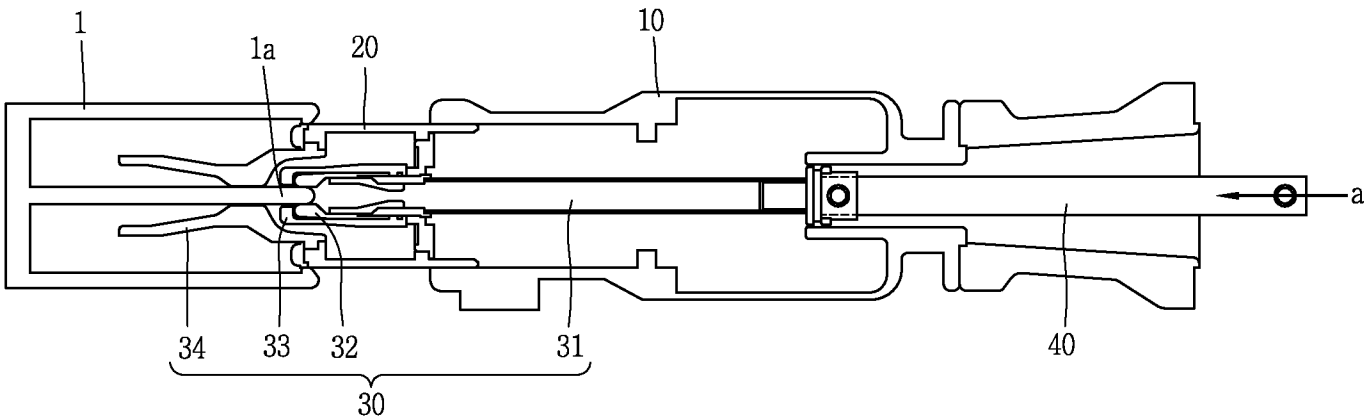
FIG. 1 RELATED ART
FIG. 1 is a cross-sectional view showing a switching mechanism for a gas insulated switch according to the related art positioned at a contacting position.
Figure 2:
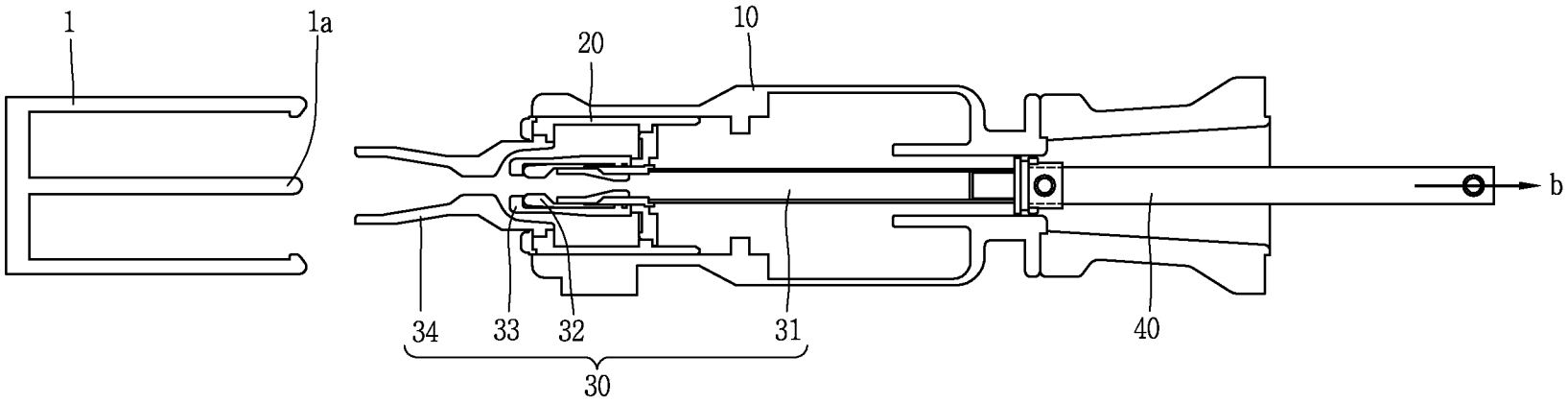
FIG. 2 RELATED ART
FIG. 2 is a cross-sectional view showing the switching mechanism for the gas insulated switch according to the related art positioned at a separating position.
Figure 3:
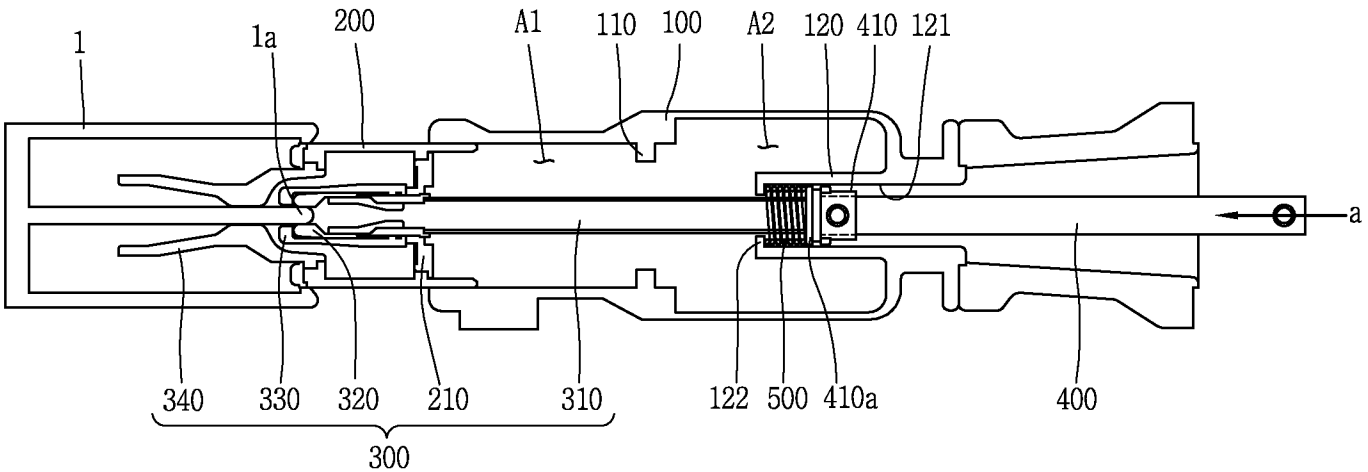
FIG. 3 is a cross-sectional view showing a switching mechanism for a gas insulated switch according to the present invention positioned at a contacting position.
Figure 4:
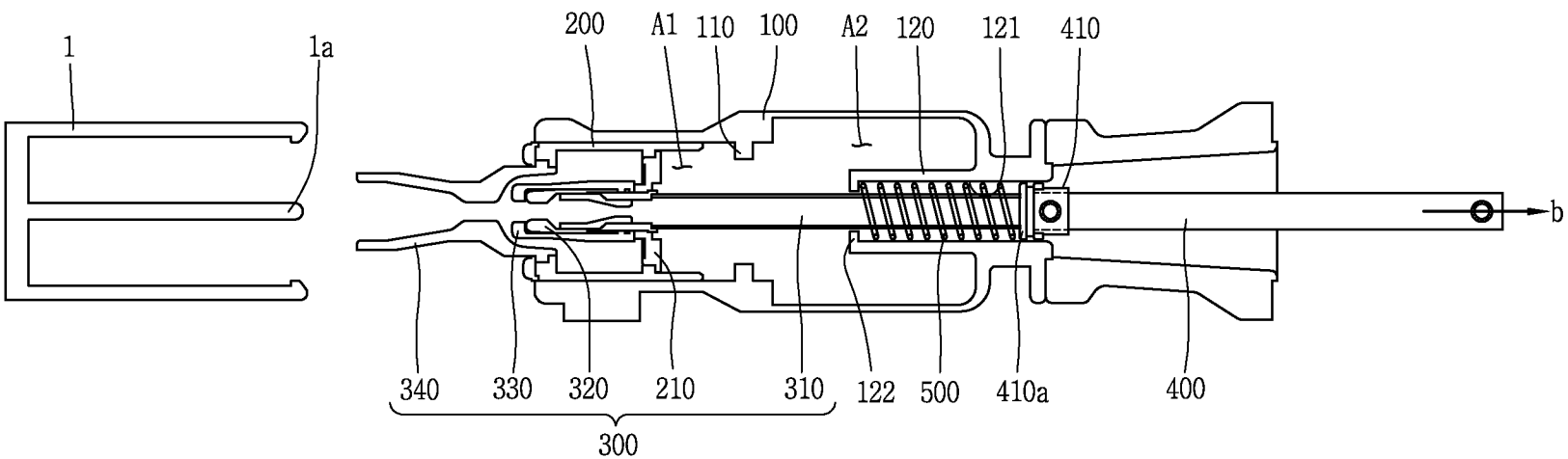
FIG. 4 is a cross-sectional view showing the switching mechanism for the gas insulated switch according to the present invention positioned at a separating position.

The above-described object of the present invention and the configuration of the present invention will become more clear by the following description of a preferred embodiment of the present invention with reference to FIGS. 3 and 4.

As shown therein, a switching mechanism for a gas insulated switchgear according to a preferred embodiment of the present invention comprises a stationary contactor 1 and 1*a*, a movable contactor portion 300, 100, and 400, and a spring 500.

As shown in FIGS. 3 and 4, the stationary contactor 1 and 1*a* comprises a stationary arc contactor portion 1*a* at the center and a stationary main contactor portion 1 fixedly installed radially outward from the stationary arc contactor portion 1*a*.

The movable contact section 300, 100, and 400 includes a stationary cylinder 100 which is hollow inside and opened at both longitudinal ends and a movable contactor portion 300 which penetrates the stationary cylinder 100 and is linearly movable.

Further, the movable contactor portion 300 includes a movable main contactor 200, a cylinder rod 310, a movable arc contactor 320, an auxiliary nozzle 330 and a main nozzle 340.

The stationary cylinder 100 accommodates the movable arc contactor 320, the movable main contactor 200 and the cylinder rod 310 to be linearly movable in the stationary cylinder 100.

The movable contact section 300, 100, and 400 may further include a connecting rod 400 having one end to be connected to the cylinder rod 310 and the other end to be connected to a driving energy source (not shown) such as a spring actuator. The connecting rod 400 transmits driving power from the driving source (power source) to the cylinder rod 30.

The connecting rod 400 and the cylinder rod 310 may be connected to a bushing 410 by a connecting pin (given no reference numeral).

The stationary cylinder 100 has a hollow guide tube portion 120 for guiding the linear motion of the cylinder rod 310 and the connecting rod 400. Reference numeral 121 indicates an inner wall surface of the guide tube portion 120.

The movable main contactor 200 is a contactor which is provided to be connected to the movable arc contactor 320 at a radially outward position relative to the movable arc contactor 320, and is linearly movable to a contacting position for contacting the stationary main contactor portion 1 and a separating position for separating from the stationary main contactor portion 1.

The movable main contactor 200 is formed further behind the movable arc contactor 320. Hence, when moving to the contacting position, the movable main contactor 200 comes in contact with the stationary contactor 1 and 1*a* later than the movable arc contactor 320 does, and when moving to the separating position, the movable main contactor 200 is separated from the stationary contactor 1 and 1*a* earlier than the movable arc contactor 320 is.

The movable main contactor 200 is connected to the movable arc contactor 320 via a piston 210 and linearly moves in the same direction as the linear motion of the movable arc contactor 320.

The cylinder rod 310 is connected to the movable main contactor 200 and the movable arc contactor 320 for transferring a driving power to provide the driving power for linear motion to the movable main contactor 200 and the movable arc contactor 320.

The cylinder rod 310 is configured by an elongate cylinder being hollow inside and has a gas communication opening portion (not shown) which communicates with the compression chamber.

The driving power of the cylinder rod 310 is obtained from the connecting rod 400 which is connected to a driving energy source such as a spring actuator.

The movable arc contactor 320 is connected to the front end of the cylinder rod 310, and linearly moves to the contacting position or the separating position in accordance with the linear motion of the cylinder rod 310.

The compression chamber for an insulating gas is formed by the inside of the stationary cylinder 100 and the piston 210, and the compression chamber communicates with internal spaces of the movable arc contactor 320, main nozzle 340, and auxiliary nozzle 330 through the cylinder rod 310.

With an extending protrusion 110 towards a center of the stationary cylinder 100 as a reference point, the compression chamber may be divided into a first compression chamber A1 positioned ahead of the extending protrusion 110 and a second compression chamber A2 positioned behind the extending protrusion 110. The insulating gas is filled in the first compression chamber A1 and the second compression chamber A2.

The first compression chamber A1 provides a space in which the movable main contactor 200, the auxiliary nozzle 330, and the main nozzle 340 can move forward or backward, and the central extending protrusion 110 determines a limit of backward movement of the movable main contactor 200.

In the second compression chamber A2, the hollow guide tube portion 120 is provided to extend toward the main nozzle 340 and the auxiliary nozzle 330.

The movable arc contactor 320 is a contactor which is linearly movable to the contacting position for contacting the stationary arc contactor portion 1*a* and the separating position for separating from the stationary arc contactor portion 1*a*.

The movable arc contactor 320 protrudes further forward than the movable main contactor 200. Hence, when moving to the contacting position, the movable arc contactor 320 comes in contact with the stationary contactor 1 and 1*a* earlier than the movable main contactor 200 does, and when moving to the separating position, the movable arc contactor 320 is separated from the stationary contactor 1 and 1*a* later than the movable main contactor 200.

The main nozzle 340 is attached to a front end portion of the movable main contactor 200 by an attachment method, e.g., welding, and blows compressed arc extinguishing gas toward the stationary arc contactor portion 1*a* so as to extinguish the arc produced when the movable arc contactor 320 is separated from the stationary arc contactor portion 1*a*.

The auxiliary nozzle 330 is attached to the movable arc contactor 320 by an attachment method, e.g., welding, so as to protrude further forward than the movable arc contactor 320, and blows the compressed arc extinguishing gas in the compression chamber toward the main nozzle 340 so as to extinguish the arc produced when the movable arc contactor 320 is separated from the stationary arc contactor portion 1*a*.

The piston 210 is means for connecting the movable arc contactor 320 and the movable main contactor 200 as described above, and also means for forming the compression chamber, together with the stationary cylinder 100.

The piston 210 compresses or expands the compression chamber while moving according to the linear forward and backward motion of the cylinder rod 310.

One end of the spring 500 is fixedly supported by a stationary spring supporting seat portion 122, and the other end thereof is supported by a movable spring supporting seat portion 410*a* which is connected to the cylinder rod 310 or the connecting rod 400 and linearly movable.

The spring 500 charges elastic energy when the movable main contactor 200 and the movable arc contactor 320 move to the contacting position, and discharges elastic energy when the movable main contactor 200 and the movable arc contactor 320 move to the separating position.

The stationary spring supporting seat portion 122 is formed to extend radially from one end of the guide tube portion 120 towards the center of the guide tube portion 120.

According to a preferred aspect of the present invention, the stationary spring supporting seat portion 122 has a through hole which permits passing through of the cylinder rod 310 because the bore of the stationary spring supporting seat portion 122 is greater than the diameter of the cylinder rod 310 and does not permit passing through of the spring 500 because the bore of the stationary spring supporting seat portion 122 is less than the diameter of the spring 500.

According to a preferred aspect of the present invention, the movable spring supporting seat portion 410*a* is configured by a flange portion of the bushing 410 for connecting the cylinder rod 310 and the connecting rod 400.

According to a preferred aspect of the present invention, the spring 500 is configured by a coil spring which is installed to surround an outer circumferential surface of the cylinder rod 310 between the stationary spring supporting seat portion 122 and the movable spring supporting seat portion 410*a*.

The operation of the thus-configured switching mechanism for the gas insulated switchgear according to a preferred embodiment of the present invention will be described with reference to FIGS. 3 and 4.

First of all, the movement of the switching mechanism from the separating position shown in FIG. 4 to the contacting position shown in FIG. 3 will be described.

The connecting rod 400 connected to a driving energy source (not shown) such as a spring actuator linearly moves from the separating position shown in FIG. 4 in the direction of arrow a of FIG. 3 by a driving power from the driving energy source.

Then, the cylinder rod 310 connected to one end of the connecting rod 400 linearly moves in the direction of arrow a, and the movable arc contactor 320 connected to the front end of the cylinder rod 310 also linearly moves in the direction of arrow a.

Therefore, the movable main contactor 200 connected to the movable arc contactor 320 via the piston 210 also linearly moves in the direction of arrow a.

Hereupon, the movable arc contactor 320 comes in contact with the corresponding stationary arc contactor portion 1*a*, and the movable main contactor 200 comes in contact with the corresponding stationary main contactor portion 1, thereby completing the movement to the contacting position as shown in FIG. 3.

At this time, according to the linear motion of the cylinder rod 310 in the direction of arrow a, the spring 500 is compressed by the movable spring supporting seat portion 410*a* approaching towards the stationary spring supporting seat portion 122 to charge elastic energy.

The movement of the switching mechanism from the contacting position shown in FIG. 3 to the separating position shown in FIG. 4 is performed in a direction opposite to that of the above-described movement.

That is, the connecting rod 400 connected to the driving energy source (not shown), such as the spring actuator, linearly moves from the contacting position shown in FIG. 3 in the direction of arrow b of FIG. 4 by the driving power from the driving energy source.

Then, the cylinder rod 310 connected to one end of the connecting rod 400 linearly moves in the direction of arrow b, and the movable arc contactor 320 connected to the front end of the cylinder rod 310 also linearly moves in the direction of arrow b.

Therefore, the movable main contactor 200 connected to the movable arc contactor 320 via the piston 210 also linearly moves in the direction of arrow b.

Hereupon, the movable main contactor 200 is separated first from the corresponding stationary main contactor portion 1. At this time, no arc is generated because the movable arc contactor 320 is still in contact with the corresponding stationary arc contactor portion 1*a*. Subsequently, the movable arc contactor 320 is separated from the corresponding stationary arc contactor portion 1*a*. At this time, the arc extinguishing gas compressed in the compression chamber is blown toward the stationary arc contactor portion 1*a* via the auxiliary nozzle 330 and the main nozzle 340, thereby rapidly extinguishing the arc.

Moreover, at this time the spring 500 expands and discharges the elastic energy through the movable spring supporting seat portion 410. Therefore, the connecting rod 400 and the cylinder rod 310 move in the direction of arrow b more rapidly, thereby accelerating the movement to the separating position.

Consequently, the movement to the separating position as shown in FIG. 4 is completed.

As seen from above, the switching mechanism for the gas insulated switchgear requires less elastic energy from a closing spring and a trip spring that function as a switching driving source because the switching mechanism includes a spring 500 for charging elastic energy when it moves to a contacting position and discharging elastic energy when it moves to a separating position.

Accordingly, it is possible to use a closing spring with relatively low elastic energy compared to the related art, thereby minimizing damage to the switching mechanism even when used for a long period of time and ensuring operational reliability.

What is claimed is:

1. A switching mechanism for a gas insulated switchgear, the switching mechanism comprising:

a stationary contactor having a stationary arc contactor portion at a center and a stationary main contactor portion fixedly installed at a radially outward position from the stationary arc contactor portion;

a movable arc contactor that is linearly movable to a contacting position for contacting the stationary arc contactor portion or to a separating position for separating from the stationary arc contactor portion;

a movable main contactor that is connected to the movable arc contactor at a radially outward position relative to the movable arc contactor and is linearly movable to a contacting position for contacting the stationary main contactor portion and to a separating position for separating from the stationary main contactor portion;

a cylinder rod that is connected to the movable main contactor and the movable arc contactor to provide driving power for linear motion to the movable main contactor and the movable arc contactor;

a connecting rod that is connected to the cylinder rod in order to transmit the driving power from a power source;

a stationary cylinder that receives the movable arc contactor, the movable main contactor, and the cylinder rod such that the movable arc contactor, the movable main contactor, and the cylinder rod are movable therein in a linear motion, the stationary cylinder having a hollow guide tube portion for guiding the linear motion; and a spring surrounding a body of the cylinder rod such that one end of the spring is supported by a stationary spring supporting seat portion and another end of the spring is supported by a movable spring supporting seat portion that is linearly moveable and connected to the cylinder rod or the connecting rod and linearly movable, wherein the spring is compressed by the movable spring supporting seat portion when the moveable spring supporting seat portion moves toward the stationary spring supporting seat portion, wherein elastic energy in the spring is:

stored when the movable main contactor and the movable arc contactor are moved to the contacting position; and released when the movable main contactor and the movable arc contactor are moved to the separating position.

2. The switching mechanism according to claim 1, wherein:

the stationary spring supporting seat portion comprises an opening having a first diameter, the opening is configured to accommodate passage of the cylinder rod through the opening, the cylinder rod having a second diameter smaller than the first diameter; and the opening is configured to prevent passage of the spring through the opening, the spring having a third diameter larger than the first diameter.

3. The switching mechanism according to claim 1, wherein the spring is configured by a coil spring which is installed to surround an outer circumferential surface of the cylinder rod between the stationary spring supporting seat portion and the movable spring supporting seat portion.

4. The switching mechanism according to claim 1, wherein the movable spring supporting seat portion is configured by a flange portion of a bushing for connecting the cylinder rod and the connecting rod.

* * * * *